US006260317B1

(12) United States Patent
Fisher

(10) Patent No.: US 6,260,317 B1
(45) Date of Patent: Jul. 17, 2001

(54) CONSTRUCTION BLOCK

(76) Inventor: Myles A. Fisher, 2006 E. Mallory St., Pensacola, FL (US) 32503

( * ) Notice: Subject to any disclaimer, the term of this patent is extended or adjusted under 35 U.S.C. 154(b) by 0 days.

(21) Appl. No.: 09/416,708

(22) Filed: Oct. 12, 1999

Related U.S. Application Data

(63) Continuation-in-part of application No. 09/034,157, filed on Mar. 2, 1998, now abandoned.

(51) Int. Cl.[7] ..... E04C 1/00

(52) U.S. Cl. ..... 52/306; 52/580; 52/590.2; 52/591.1; 52/592.1; 52/592.6; 52/775

(58) Field of Search ..... 52/96, 105, 306, 52/307, 308, 745.19, 786.1, 786.11, 786.13, 794.1, 591.1, 592.1, 592.3, 592.6, 762–764, 775, 781, 580, 590.2

(56) References Cited

U.S. PATENT DOCUMENTS

| | | | | |
|---|---|---|---|---|
| 2,392,552 | * | 1/1946 | Roe | 52/306 |
| 2,532,478 | * | 12/1950 | Bridges | 52/306 |
| 4,898,147 | * | 2/1990 | Doni et al. | 52/786.1 X |
| 5,139,595 | * | 8/1992 | Taylor | 52/786.1 X |
| 5,553,440 | * | 9/1996 | Bulger et al. | 52/786.1 X |
| 5,836,125 | * | 11/1998 | Regina | 52/306 |

* cited by examiner

*Primary Examiner*—Richard Chilcot
(74) *Attorney, Agent, or Firm*—Peter Loffler

(57) ABSTRACT

A construction block has improved thermal insulation qualities and reduces or outright eliminates the effects of a seam failure. The construction block is comprised of a pair of generally parallel faces joined by a plurality of sides. A desiccant or insulation gas, or both are disposed within the interior chamber of the block. At least one baffle is disposed within the interior chamber.

15 Claims, 2 Drawing Sheets

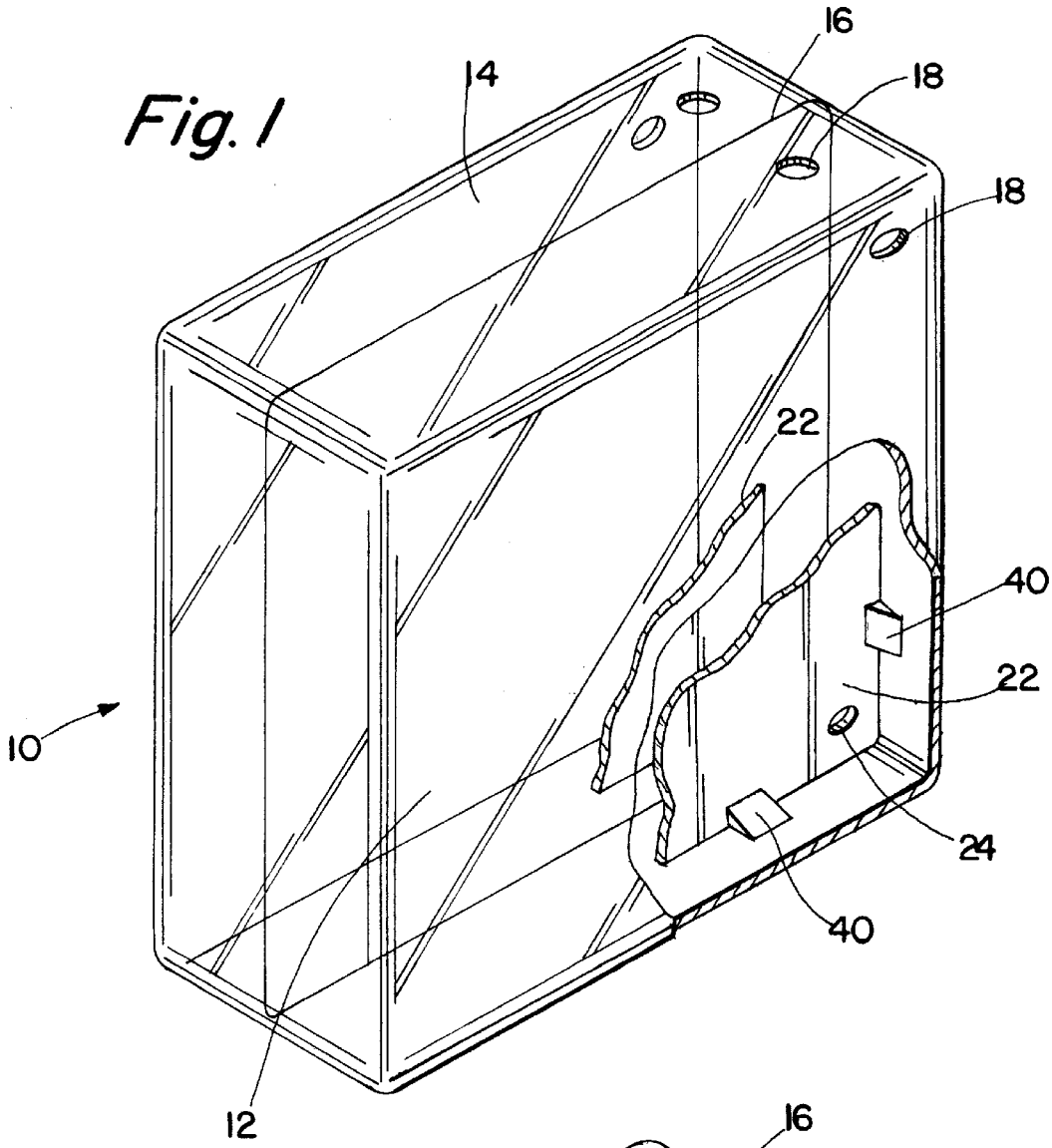
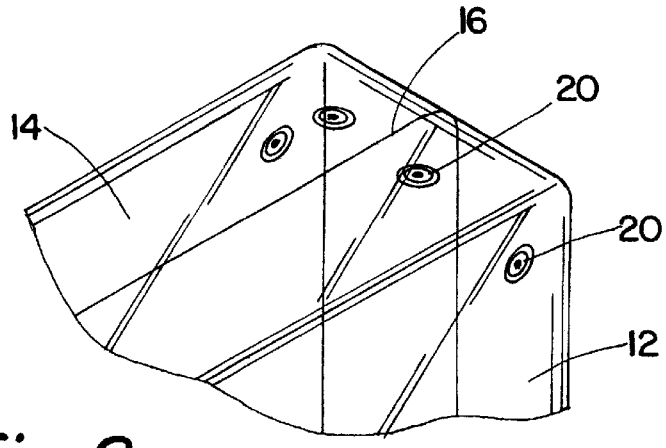
Fig. 2

CONSTRUCTION BLOCK

This application is a continuation-in-part of application Ser. No. 09/034,157 filed on Mar. 2, 1998, now abandoned.

BACKGROUND OF THE INVENTION

1. Field of the Invention

The present invention relates to a construction block having good insulation and fault-tolerant properties.

2. Background of the Prior Art

Construction blocks are typically but not necessarily rectangular members having a pair of faces joined by four sides. These blocks, which are use to build partition structures, are usually transparent or translucent and may have a texture pattern on the faces. The outer surface of the blocks may be smooth or may have an appropriate mechanism for joining the block to other blocks. U.S. Pat. No. 5,595,033 to Frey, U.S. Pat. No. 5,588,271 to Pitchford and my U.S. patent application Ser. No. 08/603,460 filed Feb. 20, 1996 are examples of such mechanisms. The blocks, which are made from glass, plastic or a similar material, are typically formed as two generally identical halves welded together forming a seam.

These construction blocks, which enjoy wide popularity in the construction industry, have several areas that can benefit from improvement. Although, modern construction blocks have a relatively high level of thermal insulation and sound insulation capability, these levels can always withstand being raised. Another problem with present construction blocks is found in seam failure. A small hole along the seam not only reduces the insulation properties of that block but also serves as in introduction point for moisture to enter the interior chamber of the block. The moisture within the block condenses and becomes unsightly. The moisture introduction is exacerbated by the bellowing effect created by the block due to the difference in temperature between the block face on the interior of the building and the temperature of the block face on the exterior of the building.

Therefore, there is a need in the art for a construction block that addresses the aforementioned shortcomings of the present-day blocks. Such a construction block must have improved thermal properties and must limit the adverse effects of a failed seam.

SUMMARY OF THE INVENTION

The construction block of the present invention addresses the aforementioned needs in the art. The construction block increases the thermal efficiency and sound insulation of the block. The construction block also attacks the moisture problem experienced from a failed seam by outright eliminating the condensation within the interior chamber of the block or by isolating the condensation from the sight of a user. The bellowing effect—which tends to pull air from the exterior of the block into the interior chamber of the block through the pinhole—created by the block is also reduced. A method of increasing the thermal efficiency or eliminating the condensation is also disclosed.

The construction block of the present invention is comprised of a body having a pair of faces joined by a plurality of side edges, each having an inner surface and an outer surface, defining an interior chamber. The body of the construction block is formed from two similar half bodies joined, in airtight fashion, along a seam.

Means for joining the construction block with other construction blocks, may but need not be provided.

An appropriate desiccant, an insulation gas or both are disposed within the interior chamber of the construction block. The desiccant lies at the bottom of the construction block out of sight of a user. At least one opening can be provided on the block for introduction of the desiccant or insulation gas, the opening being airtight sealed after introduction. Alternately, at least one weakened area, which may or not be perforated, may be provided on the construction block. The weakened area can be punched by a screwdriver or similar instrument for creating the opening. A locator mark can be provided on the block in the area defined by the weakened area for easy and consistent location of the weakened area. Alternately, the locator mark can be provided on the block (without the block having a weakened area) so that a person can drill an opening at the locator mark. The opening, weakened area, or locator mark can be located on at least one of the faces, on at least one of the sides or both. By providing these members on the side of the block, the sealed opening will not be visible to a user.

At least one baffle is disposed within the interior chamber. The baffle, which is a generally planar member may but need not have at least one opening located thereon. The at least one opening allows any introduced insulation gas to fill the entire construction block as opposed to only a portion of it. The baffle may be friction held in position or may have its outer periphery tapered to meet the taper of the taper of at least one of the inner surfaces. A second taper on the baffle (or the first taper if not used for positioning) may serve as a trough for receiving a sealant to airtight seal the baffle into place along the baffle's outer periphery. A retainer may be used for holding the baffle in place. The retainer may be in the form of a continuous groove or may be a bump, a ridge, or a one-way ramp. The bump, ridge or one-way ramp may be one continues member or may be a series of discrete members. The baffle is inserted into the interior chamber until it is pushed into the retainer in the case of the groove, or otherwise past the retainer. A second retainer or series of retainers may be provided beyond the baffle for sandwiching the baffle therebetween.

The baffle may have an appropriate optical coating thereon.

The baffle serves several important roles. The baffle adds additional thermal insulation capacity and sound insulation capacity to the construction block. The baffle reduces the bellow effects created by the inner positioned face and the outer positioned face. The baffle separates the interior chamber into two or more sub-chambers. For example, by placing two baffles into the interior chamber, one baffle on one side of the seam and the other baffle on the other side of the seam, the interior chamber is separated into three sub-chambers. Therefore, any moisture and the resulting condensation that is introduced into the construction block through a failure in the seam is isolated within the middle sub-chamber out of sight of a user. Lastly, the baffles may be used to add to the overall aesthetic qualities of the block by coming in different colors, patterns including light diffusing patterns, smoked appearance, etc.

BRIEF DESCRIPTION OF THE DRAWINGS

FIG. 1 is a perspective view, partially sectioned for clarity, of the construction block of the present invention.

FIG. 2 is a close-up view of one of the corners of the construction block.

Similar reference numerals refer to similar parts throughout the several views of the drawings.

DESCRIPTION OF THE PREFERRED EMBODIMENT

Figure 3:
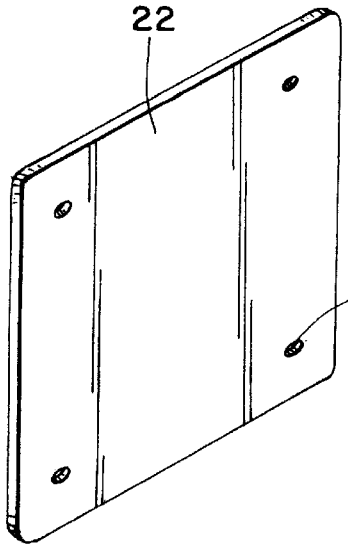
FIG. 3 is a perspective view of the baffle.
Figure 4A:
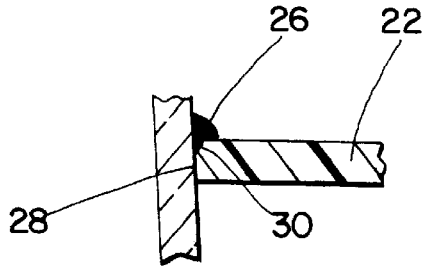
FIG. 4A is a close-up of a portion of FIG. 4.
Figure 4:
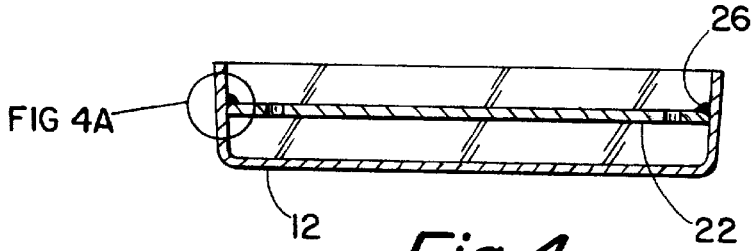
FIG. 4 is a cross-section view of the baffle seated within an inner surface of the construction block.
Figure 5:
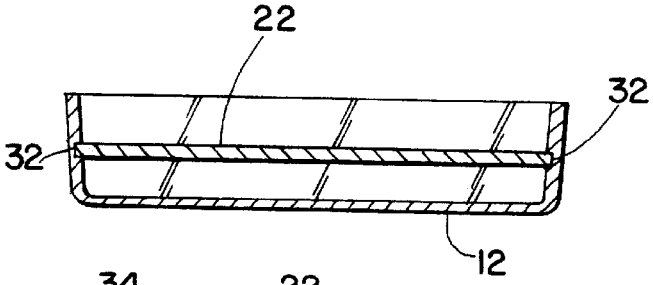
FIGS. 5–8 illustrate in cross-section, the various retainers that may be used to hold the baffle within the construction block.

Referring now to the drawings, it is seen that the construction block of the present invention, generally denoted by reference numeral 10, is comprised of a generally rectangular body having a pair of face 12 joined by four side edges 14, each having an inner surface and an outer surface, defining an interior chamber. The body is formed from two similar halves that are joined, in airtight fashion, along a seam 16. The airtight joiner of the two halves can be accomplished in appropriate fashion such as using an appropriate adhesive along the seam 16, ultrasonically welding the two halves along the seam 16, etc. It is expressly understood that the construction block 10 can be constructed in a shape other than rectangular, and having other than four sides, in keeping within the scope and spirit of the present invention. The outer surface of the construction block 10 can be generally smooth, or can have any appropriate structure for joining the construction block 10 to other construction blocks 10. The faces 12 of the construction block 10 can be transparent, translucent, or opaque. The faces 12 may also have an appropriate textured surface, such as a wave pattern, column pattern, etc., if desired. The construction block 10 body is formed from an appropriate resin material, such as acrylic.

Disposed within the interior chamber of the construction block 10 is an appropriate desiccant for absorbing any moisture within the interior chamber. As the desiccant will fall to the bottom of the interior chamber, it will not be readily visible even in a construction block 10 having transparent faces 12. Alternately, or in addition to the desiccant, an insulation gas may be disposed within the interior chamber. The insulation gas is chosen from the group consisting of argon, krypton, xenon, or combinations thereof or any other insulating gas or combination thereof.

In order to introduce the desiccant or insulation gas into the interior chamber, the construction block 10 may be formed with at least one opening 18 located thereon, as illustrated in FIG. 1. The opening 18 can be located on at least one of the faces 12, on at least one of the sides 14 or both. After the desiccant or insulation gas is introduced into the interior chamber, each opening 18 is sealed airtight in any appropriate fashion. Alternately, at least one weakened portion can be provided on at least one of the faces 12, on at least one of the side edges 14, or both. The weakened portion may be punched out with a screwdriver, drill or other similar tool and the desiccant or insulation gas introduced through the opening thus created. Again, after the desiccant or insulation gas is introduced into the interior chamber, each opening is airtight sealed in any appropriate fashion. A locator mark 20 can be provided on the area encompassed by the weakened portion for easy location of the weakened area. Alternately, a locator mark 20 may be provided on any appropriate portion of the construction block 10 so that the area identified by the locator mark 20 may be drilled to provide a consistent location for the opening for introduction of the desiccant or insulation gas. Again, after the desiccant or insulation gas is introduced into the interior chamber, each opening is airtight sealed in any appropriate fashion.

As seen in FIGS. 1 and 3–8, at least one baffle 22 can be disposed within the interior chamber. The baffle 22 is a generally planar member having an outer periphery and is in a shape generally similar to the shape of the interior chamber defined by the side edges 14. At least one opening 24 can be located on the baffle 22. The baffle 22 may be formed directly with the construction block 10. Alternately, the baffle 22 may be a separate member that is inserted into the appropriate position within the interior chamber. The baffle 22 may be friction held in place, and, if desired, airtight sealed into place by an appropriate sealant 26. The outer periphery of the baffle 22 may have a first taper 28 and the inner surface of at least one side edge 14 may also have a complimentary taper for receiving the first taper 28. A second taper 30 (this may be the only taper if the first taper 28 is not used) may be located on the outer periphery of the baffle opposite the first taper 28, this second taper 30 is used as a trough for receiving the sealant 26.

Figure 6:
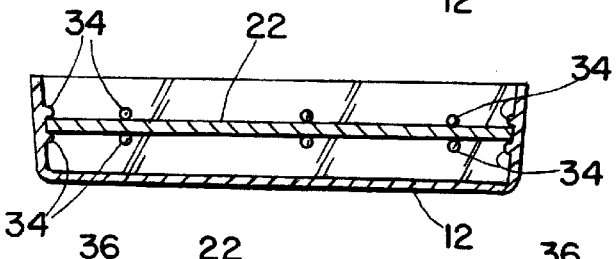
Figure 7:
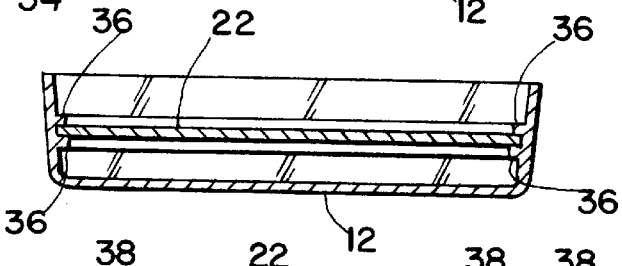
Figure 8:
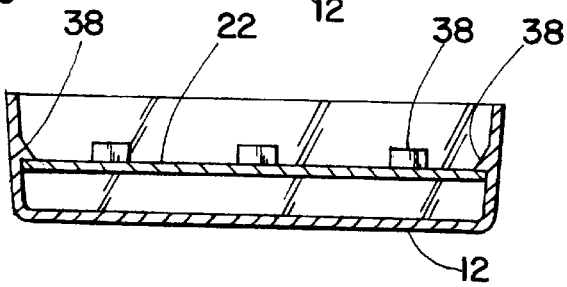

As seen in FIGS. 5–8, a retainer can be used for holding the baffle 22 in place. The retainer can be of any desired construction including the groove 32 illustrated in FIG. 5, the at least one hemispheric bump 34 illustrated in FIG. 6, the at least one ridge 36 illustrated in FIG. 7, or the at least one one-way ramp 38 illustrated in FIG. 8. The retainer can be one continuous member as seen in FIG. 7 or can be a series of discrete members as seen in FIGS. 6 and 8. The groove 32 must be a continuous member on each side edge 14 on which it is located. The baffle 22 is inserted into place until it is received within the retainer in the case of the groove 32 or until it passes the first retainer or series of retainers. Furthermore, a second one or second series of at least one bumps 34, ridges 36, or one way ramps 38 can, but need not be provided on the opposite side of the baffle 22 to hold the baffle sandwiched between the two series of retainers.

Each baffle 22 can be provided with an optical coating on one or both surfaces. This coating can be used to control the effects of the sun, such as an ultraviolet light barrier coating or can be a visual coating, such as a tint, a color, or a reflective surface in order to change the overall appearance created by the construction block 10. By placing the coating on the baffle 22 as opposed to one or both of the faces 12 of the construction block 10, the manufacturing costs tend to be reduced and the coating, which tends to be soft, is safely sealed within interior of the construction block 10 so that it cannot be scratched or otherwise tampered.

While the invention has been particularly shown and described with reference to an embodiment thereof, it will be appreciated by those skilled in the art that various changes in form and detail may be made without departing from the spirit and scope of the invention.

What is claimed is:

1. A construction block comprising: a body formed from a resinous material the body formed by a pair of face portions with inwardly directed side portions, edge portions of the side portions in abutting relationship and joined by a welded or adhesive seam defining an interior chamber; and a baffle having an outer periphery, located within the interior space and disposed generally parallel with the pair of faces to form two separate areas within the interior chamber whereby a bellow effect of the faces is reduced.

2. The construction block as in claim 1 wherein the outer periphery of the baffle has a first taper.

3. The construction block as in claim 2 wherein at least one of the inner surfaces has a second taper.

4. The construction block as in claim 2 further comprising a retainer located on at least one of the inner surfaces.

5. The construction block as in claim 2 wherein the outer periphery of the baffle has a second taper.

6. The construction block as in claim 5 further comprising a retainer located on at least one of the inner surfaces.

7. The construction block as in claim 1 further comprising a sealant for sealing the outer periphery of the baffle to the inner surfaces.

8. The construction block as in claim 1 further comprising an opening located on the baffle.

9. The construction block as in claim 1 further comprising a desiccant disposed within the interior chamber.

10. The construction block as in claim 1 further comprising an insulation gas disposed within the interior chamber.

11. The construction block as in claim 10 wherein the insulation gas is selected from the group consisting of argon, krypton, xenon or combinations thereof.

12. The construction block as in claim 1 further comprising at least one locator mark located on the construction block.

13. The construction block as in claim 1 further comprising at least one weakened portion located on the construction block.

14. The construction block as in claim 1 further comprising at least one opening located on the construction block.

15. The construction block as in claim 1 further comprising an optical coating on the baffle.

* * * * *